United States Patent [19]

Domizio

[11] Patent Number: 5,004,208

[45] Date of Patent: Apr. 2, 1991

[54] REMOVABLE RECESS FORMING INSERT

[76] Inventor: George T. Domizio, 106 Punkup Rd., Oxford, Conn. 06483

[21] Appl. No.: 469,959

[22] Filed: Jan. 25, 1990

[51] Int. Cl.[5] ..... E04G 15/04

[52] U.S. Cl. ..... 249/91; 52/125.4; 249/95; 249/177; 249/183

[58] Field of Search ..... 249/95, 177, 183, 184, 249/91, 96, 185, 219.1; 52/699, 700, 701, 704, 125.4, 125.5; 294/89, 90

[56] References Cited

U.S. PATENT DOCUMENTS

| | | | |
|---|---|---|---|
| 1,045,587 | 11/1912 | Morley | 52/125.4 |
| 2,344,206 | 3/1944 | Forni | 52/125.4 |
| 2,366,656 | 1/1945 | Saffert | 249/95 |
| 2,623,261 | 12/1952 | Semeraro | 249/183 |
| 3,534,668 | 10/1970 | Scheincha | 52/125.4 |
| 3,731,902 | 5/1973 | Shoemaker | 249/95 |
| 4,087,947 | 5/1978 | Turner | 52/699 |
| 4,296,909 | 10/1981 | Haeussler | 249/177 |
| 4,797,081 | 1/1989 | Prater | 425/275 |
| 4,821,994 | 4/1989 | Fricker | 249/95 |

FOREIGN PATENT DOCUMENTS

| | | | |
|---|---|---|---|
| 3629772 | 3/1988 | Fed. Rep. of Germany | 249/95 |
| 554163 | 6/1977 | U.S.S.R. | 249/183 |

*Primary Examiner*—James C. Housel

*Attorney, Agent, or Firm*—Ware, Fressola, Van Der Sluys & Adolphson

[57] ABSTRACT

A removable recess forming rubber insert is immersed in wet concrete after pouring, installing in the resulting concrete unit a lifting anchor or stirrup for moving the concrete unit with a lifting hook and cable. The rubber insert, has a stirrup eye for supporting and encompassing a portion of the lifting stirrup and a stirrup release slot for releasing the stirrup as the insert is removed from the hardened concrete unit. The insert utilizes a standard reinforcing bar as the lifting stirrup. The insert is formed as a mold body having a semi-cylindrical lower face to allow easy removal of the insert and to provide a recess for access to the lifting stirrup by a lifting hook. A protruding mold thumb is used to remove the insert after the concrete unit has hardened.

16 Claims, 1 Drawing Sheet

REMOVABLE RECESS FORMING INSERT

BACKGROUND AND SUMMARY OF INVENTION

This invention relates to methods and apparatus for providing lifting bails or stirrups in recesses in concrete blocks, and more particularly, to a removable recess-forming insert used for forming recessed pin anchors for the tilting or lifting of concrete wall slabs, cast concrete manholes and the like.

Pre-cast concrete blocks, manholes, and wall slabs need to be moved from place to place at various times. The accustomed method of moving the concrete articles is the utilization of lifting hooks, engaging recessed hoisting bails or stirrups which are embedded in the wet concrete mixture prior to hardening, and, when the concrete hardens, a hoisting cable or hook is engaged with the bail or stirrup and, thus, the article is moved. An important consideration is to ensure that the stirrup is entirely recessed into the cement article so that, when the lifting hook or cable is removed, there are no unwanted projections. Moreover, the stirrup or bail must be firmly anchored in the cement object in order to withstand the rather considerable stresses imposed upon it.

Various methods and devices have been employed to install a bail or stirrup by which the concrete object could be moved. These include the use of both removable and permanent inserts by which a recess is formed to allow access to the lifting stirrup. Both Morley, U.S. Pat. No. 1,045,587 and Forni, U.S. Pat. No. 2,334,206 teach the use of a removable insert which not only molds a recess to access the lifting stirrup but also holds the stirrup in place as the concrete object hardens. Morley utilizes a destructible soft cement mold while Forni uses a wood insert, both of which are knocked out of the concrete object after it hardens. In Saffert, U.S. Pat. No. 2,366,656, a pair of lugs tacked to a base surface form the recess mold, and a cooperating specially manufactured anchor is utilized as the lifting hook for the anchor holding apparatus. In Turner, U.S. Pat. No. 4,087,947, a flexible rubber supporting and pattern ring is glued or cemented to the concrete form wall while supporting an anchor assembly including an anchor bolt, a hangar clip, and a reinforcing rod. The form wall and support/pattern ring are pulled away from the hardened concrete and anchor assembly to allow access to the newly formed hoisting anchor assembly.

Various practical economic problems arise with the use of removable recess forming inserts. Naturally, reusability of the insert is desired as well as facility of its use (i.e., minimum amount of preparation, minimum number of components, etc.). Additionally, it is desirable that the recess forming insert may be used with a standard reinforcing bar or the like, and not require additional hardware. Standard reinforcing bars are used for various other purposes including the reinforcement of concrete slabs and the like, and, therefore, are common at construction sites or other places where concrete slabs may be formed. Moreover, simplicity of its assembly, installation, and removal is highly advantageous.

The present invention incorporates all these desired advantages in a simple and economical package. The insert is formed of elastomeric material whose inherent resilient properties allow for quick and effortless removal from hardened concrete in preparation for the insert's next use, while its simple split block form employing a length of standard reinforcing bar provides an easily attainable and effective hoisting stirrup. Finally, the insert's novel shape allows for easy assembly, installation and removal for re-use.

The coupling of these useful features for the installation of lengths of standard reinforcing bar utilized as hoisting stirrups, and the formation of recesses to access these stirrups is not believed to be disclosed or suggested by any of the prior art patents. The inventor has thus discovered that the novel implementation of a split rubber block performs this operation more simply and effectively than the prior devices and methods.

Accordingly, a principal object of the present invention is to provide a simple but effective means for installing a length of standard reinforcing bar to be utilized as a hoisting stirrup in concrete objects, for the purpose of moving those objects, and for providing access to the hoisting stirrup.

A further object of the invention is to provide an easily installable anchoring device for concrete slabs and the like.

Another object of the invention is to provide a device for installing an anchor, for concrete objects and providing access to the anchor, which anchor can be easily removed and is reusable.

Another object of the invention is to provide a removable recess forming, anchor installing insert which is simple and economical to fabricate.

Another object of the invention is to provide a device for installing a standard reinforcing bar length in a concrete object for use as an anchor and providing an access thereto while requiring no additional equipment or specialized stirrup components.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings, in which:

THE DRAWINGS

Figure 1:
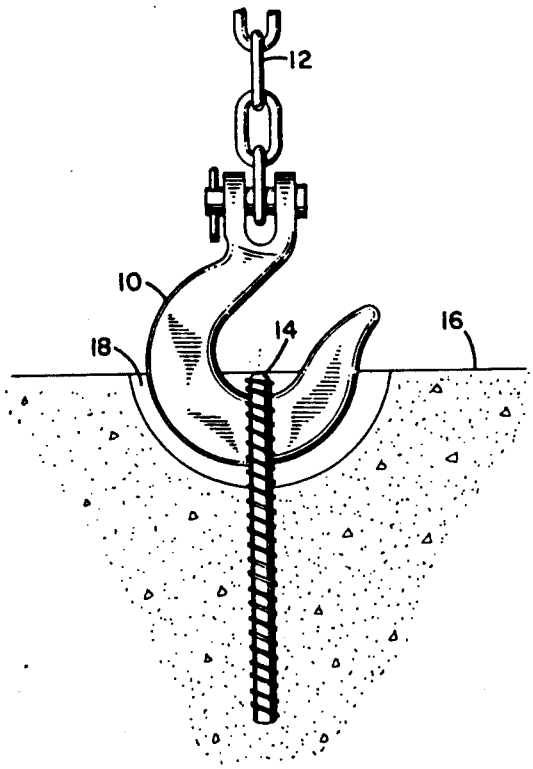
FIG. 1 is a side elevational view partially in cross-section, showing the operation of moving a concrete slab employing a length of standard reinforcing bar being utilized as a hoisting stirrup installed by the present invention.

Referring now to the drawings in detail and, in particular, FIG. 1, the manner in which a hook 10 of a hoisting chain 12 engages a stirrup 14 to effect raising a concrete unit 16 utilizing a lifting hook recess 18 is shown. The stirrup 14, in the preferred embodiment, is comprised of a length of a standard reinforcing bar or rod. Reinforcing rods, or bars, which are customarily used on construction sites to provide reinforcement for a concrete column, beam, slab or the like, are manufactured to various lengths and diameters. The diameter of the reinforcing bar to be used as a hoisting stirrup must be chosen according to the size and weight of the concrete unit to be lifted and to the availability at the site of the desired reinforcing bar. The reinforcing bar is cut to length and bent in a form similar to that shown in FIG. 2A to provide the concrete unit with a sturdy hoisting stirrup 14.

Referring again to FIG. 1, the lifting hook recess 18, spanned by stirrup 14, is created during the casting of a concrete wall slab, a concrete manhole chamber, or the like, by the use of a removable recess forming insert of the present invention. The recess 18 preferably has the shape of a semi-cylinder and must be dimensioned such that a lifting hook will have easy access to the hoisting stirrup while providing maximum support to the stirrup.

Figure 2A:
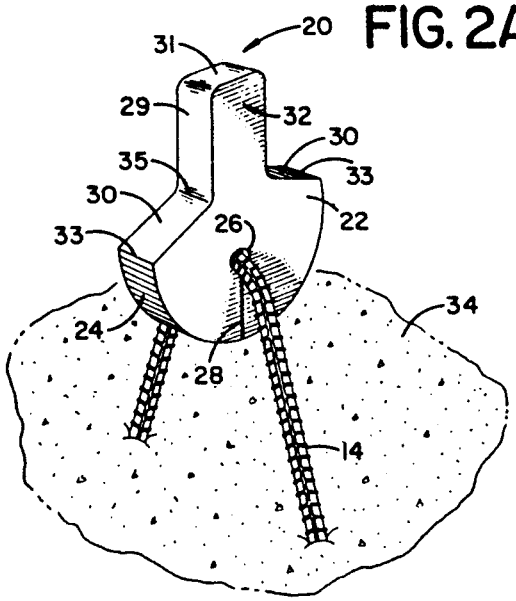
FIG. 2A is a perspective view of a removable recess forming insert of the present invention, shown assembled with a length of standard reinforcing bar to be utilized as a hoisting stirrup, as its immersion in wet concrete is just beginning.

The novel removable recess forming insert 20 of the present invention is shown in detail in FIG. 2A. The insert 20 is made of neoprene or some other rubber-like material and is comprised of the mold body 22, which, on its front and back, is flat but has an arcuate face 24 that forms a virtual semi-cylindrical lower face about the center of the mold body 22. The semi-cylindrical arcuate shape of the mold body face 24 allows the insert 20 to be easily removed from a hardened concrete unit 16.

A stirrup eye 26, which is a cylindrical hole through the mold body 22, lies in the approximate geometric center of the mold body 22. The stirrup eye 26 has a diameter which is sufficient to encompass a length of standard reinforcing bar. Because reinforcing bar is manufactured in various diameters (i.e., ½", ⅜-, etc.), the stirrup eye diameter will be selected according to the size of the bar used.

Directly beneath the stirrup eye 26 lies a stirrup release slot 28, which is an incision the width of the mold body 22 along the stirrup eye center axis beginning at the bottom of the stirrup eye 26 and terminating at the base of the mold body face 24. The stirrup release slot 28 provides, for the stirrup 14, a manner in which the stirrup 14 may exit the mold body 22 as the insert 20 is removed from a hardened concrete unit 16.

The semi-cylindrical shape of the mold face edge 24 is terminated by the mold shoulders 30. Each mold shoulder 30 has a first lower outer edge 33 joined to the mold body face 24 and a second upper inner edge joined to a mold thumb 32. Both shoulders 30 extend inwardly from the mold body lower outer edge 33, terminating at the mold thumb 32, and they have a substantially flat surface. The mold shoulders 30 are beveled at an angle such that, during the casting process, any concrete which happens to come into contact with the shoulders 30 will not remain and thus preventing the insert 20 from being sealed in the hardened concrete unit 16.

The mold thumb 32, which provides a gripping projection for the insert 20, is bounded by four substantially vertical front, rear and side walls 29 (two walls are shown in FIG. 2A) extending upwardly from the mold shoulders 30 and the mold body 22 to a substantially horizontal terminating cap surface 31. The size of the mold thumb 32 (i.e., height, width, and depth) is to be determined such that the combination of the dimensions will facilitate the process of grasping the mold thumb 32 by hand for the removal of the insert 20, or withstanding a hammer blow parallel to stirrup 14 to pop mold body 22 upward, prying it off stirrup 14 by spreading slot 28.

It should be noted, however, that, with the exceptions of the stirrup eye 26 and the stirrup release slot 28, the recess forming insert 20 is a continuous solid piece of rubber or similar material, bounded by the surfaces 24, 29, 30, 31.

Figure 3:
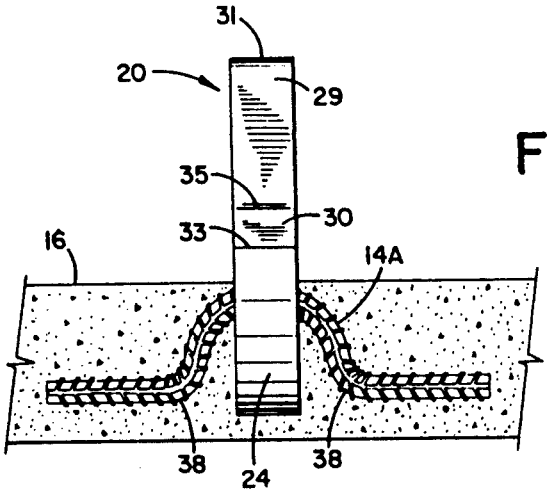
FIG. 3 is a side elevation view, partially in cross-section, of the removable recess forming insert of the present invention, shown assembled with a second embodiment of a length of reinforcing bar and inserted in a concrete unit.

In actual operation, the recess forming insert 20 is configured as shown in FIG. 2A, in that a length of reinforcing bar or a stirrup 14, bent in an inverted U-shape with diverging legs so as to be able to perform as a lifting bail, is positioned in the stirrup eye 26. The angle formed between the two diverging legs is preferably between 60 and 150 degrees although other angle values may be chosen. FIG. 3 shows an insert 20 in operation with a stirrup 14A bent in an inverted U-shape whose diverging legs have an additional bend at elbows 38 such that the legs extend outwardly from the stirrup's center. Stirrup 14A is optimally utilized in less thick concrete units.

After wet concrete has been poured as shown in FIG. 2A, the recess forming insert 20 and stirrup 14 are forced into concrete mixture 34 until the concrete reaches and immerses the top of the stirrup eye 26.

Figure 2B:
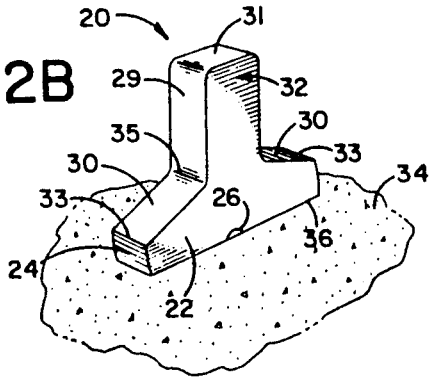
FIG. 2B is a perspective view of the same insert, shown embedded in the wet concrete slab during the recess forming process.

FIG. 2B illustrates a recess forming insert 20 of the present invention shown after insertion in a wet concrete mix 34. The insert 20 retains stirrup 14 in stirrup eye 26 beneath the wet concrete surface 36 and, therefore it is hidden from view. After the concrete 34 has been allowed to cure or harden, the removable recess forming insert 20 can then be removed from the concrete unit 16 by grasping the mold thumb 32 and pulling it upward away from the now hardened concrete unit 16.

Figure 2C:
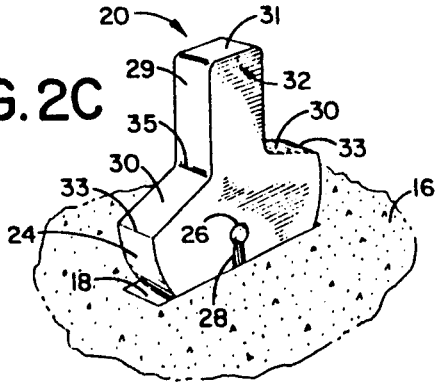
FIG. 2C is a corresponding perspective view of the same insert after completion of the recess forming process, shown during its removal from the concrete slab.
Figure 2D:
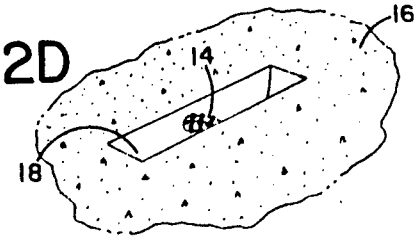
FIG. 2D is a corresponding perspective view of the recess and anchor as installed by the recess forming device of the present invention.

FIG. 2C illustrates a recess forming insert 20 of the present invention shown after the insert 20 has been partially removed from a hardened concrete unit 16. As the insert 20 is removed, a recess 18 in the shape of the insert 20 can be seen. Additionally, the release slot 28 is shown to spread apart, releasing insert 20 while allowing the stirrup 14 to remain firmly embedded in the concrete unit 16 as previously discussed hereinabove. FIG. 2D shows the recess 18 in concrete unit 16 as formed by insert 20. The center portion of the stirrup 14 spans the recess 18, free of any concrete.

Because the mold body 22 completely envelopes the center portion of the stirrup 14 in the concrete mixture 34 during the hardening process, the center portion of stirrup 14 remains free of concrete, and it becomes accessible to hoisting cable 12 and associated hook 10 after the insert 20 is removed, as shown in FIG. 1. Because the mold body 22 has a semi-cylindrical shape, the removal of the insert 20 is nearly effortless because the mold body edge 24 is allowed to slide up the recess 18 as the release slot 28 spreads open as described hereinabove. Moreover, the resiliency of the elastomeric material of the device 20 is utilized to free the insert 20 from any hardened concrete thus allowing the insert 20 to be easily removed. Furthermore, because the insert 20 is composed of rubber or rubber-like material, the insert 20 can be reused repeatedly, thus saving the expense of purchasing new insert forms. Finally, the removable recess forming insert 20 improves upon the prior art in that it requires no special equipment (i.e., special mounting bolts, etc.) and utilizes a standard reinforcing bar as the slab-lifting bail or stirrup.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A removable recess forming insert for supporting a hoisting stirrup made of a length of reinforcing bar immersed below the surface level of a wet concrete mixture during curing, and for forming a recess to allow access to said stirrup by a lifting hook after said wet concrete mixture hardens thereby forming a liftable concrete unit, said insert being composed of continuous, solid elastomeric material comprising in combination:

A. a vertically elongated mold body shaped to form said recess for stirrup access having substantially flat front and back surfaces, said front surface being disposed in parallel with said back surface, having a bottom surface extending from said front surface to said back surface, said bottom surface having a curved shape, and incorporating disengageable means for gripping said hoisting stirrup and alternately releasing said stirrup to detach the mold body from the concrete unit after curing, said gripping means having a stirrup eye extending from said front surface to said back surface forming a cylindrical hole therethrough, said hole having an axis substantially parallel to said bottom surface, B. a mold thumb protruding vertically from said mold body and forming an upstanding griping projection by which said mold body may be seized and disengaged from the concrete unit after curing, and C. mold shoulders extending inwardly from opposite ends of the bottom surface of said mold body to said mold thumb.

2. The removable insert defined in claim 1, wherein said stirrup eye forms a right circular cylindrical hole through said mold body for supporting and encompassing a portion of said hoisting stirrup.

3. The removable insert defined in claim 2, wherein said disengageable gripping means further comprises a stirrup release slot through said mold body, extending from said stirrup eye to said bottom surface, for releasing said stirrup from said mold body.

4. The removable insert defined in claim 3 wherein said stirrup release slot extends radially downwardly from said stirrup eye to said bottom surface.

5. The removable insert defined in claim 1 wherein said mold shoulders are beveled for preventing accumulation of concrete thereon.

6. The removable insert defined in claim 1 wherein said mold shoulders extend on said mold body from first outer edges at the opposing ends of the bottom surface to converge with said mold thumb at second inner edges, said outer edges being disposed lower than said inner edges for preventing accumulation of concrete thereon.

7. The removable insert defined in claim 6 wherein said mold shoulders have substantially flat downward slanting surfaces.

8. The removable insert defined in claim 1 wherein said mold thumb has four flat sides and a flat top.

9. A device for providing a concrete object with a recessed anchor for lifting said concrete object with a lifting hook, said anchor being a hoisting stirrup formed of a length of reinforcing bar, said device comprising a removable recess forming insert, said insert being composed of continuous solid elastomeric material and comprising a vertically elongated mold body for supporting said hoisting stirrup immersed below the surface of a wet concrete mixture during the hardening process and for forming a recess in said concrete object to allow access to said hoisting stirrup when said insert is removed from said concrete object after curing, said mold body having substantially flat front and back surfaces, said front surface being disposed in parallel with said back surface, having a bottom surface extending from said front surface to said back surface, said bottom surface having a curved shape, and incorporating disengageable means for gripping a portion of said hoisting stirrup and releasing said stirrup from said mold body, said gripping means having a stirrup eye extending from said front surface to said back surface forming a cylindrical hole therethrough, said hole having an axis substantially parallel to said bottom surface, a mold thumb attached to said mold body opposite said bottom surface for removing said insert from said stirrup and said concrete object after curing; and mold shoulders extending inwardly from opposite ends of the bottom surface of said mold body to said mold thumb.

10. The device defined in claim 9 wherein said stirrup eye forms a right circular cylindrical hole through said mold body, for supporting and encompassing a portion of said hoisting stirrup.

11. The device defined in claim 10 wherein said disengageable gripping means further comprises a stirrup release slot through said mold body, extending from said stirrup eye to said bottom surface, for releasing said stirrup from said mold body.

12. The device defined in claim 11 wherein said stirrup release slot extends radially downwardly from said stirrup eye to said arcuate bottom surface.

13. The device defined in claim 9 wherein said mold shoulders are beveled for preventing accumulation of concrete thereon.

14. The device defined in claim 13 wherein said mold shoulders have substantially flat surfaces.

15. The device defined in claim 9 wherein said mold shoulders extend on said mold body from first outer edges at the opposing ends of the bottom surface to converge with said mold thumb at inner second edges, said outer edges being disposed lower than said inner edges for preventing accumulation of concrete thereon.

16. The device defined in claim 9 wherein said mold thumb has four flat sides, each side being parallel to one other side and perpendicular to two other sides, and a flat top being perpendicular to all four sides.

* * * * *